US011232738B2

(12) United States Patent
Zhou et al.

(10) Patent No.: US 11,232,738 B2
(45) Date of Patent: Jan. 25, 2022

(54) DISPLAY DEVICE AND METHOD OF COMPENSATING SAME

(71) Applicant: Wuhan China Star Optoelectronics Semiconductor Display Technology Co., Ltd., Wuhan (CN)

(72) Inventors: Yang Zhou, Wuhan (CN); Yong Zhao, Wuhan (CN); Mugyeom Kim, Wuhan (CN)

(73) Assignee: Wuhan China Star Optoelectronics Semiconductor Display Technology Co., Ltd., Wuhan (CN)

( * ) Notice: Subject to any disclaimer, the term of this patent is extended or adjusted under 35 U.S.C. 154(b) by 0 days.

(21) Appl. No.: 16/476,275

(22) PCT Filed: Mar. 19, 2019

(86) PCT No.: PCT/CN2019/078735
§ 371 (c)(1),
(2) Date: Jul. 6, 2019

(87) PCT Pub. No.: WO2020/133739
PCT Pub. Date: Jul. 2, 2020

(65) Prior Publication Data

US 2021/0335186 A1 Oct. 28, 2021

(30) Foreign Application Priority Data

Dec. 26, 2018 (CN) ..... 201811603233.5

(51) Int. Cl.
*G09G 3/20* (2006.01)
*G09G 5/10* (2006.01)

(52) U.S. Cl.
CPC ..... *G09G 3/2003* (2013.01); *G09G 5/10* (2013.01); *G09G 2320/0242* (2013.01);
(Continued)

(58) Field of Classification Search
None
See application file for complete search history.

(56) References Cited

U.S. PATENT DOCUMENTS

2008/0055209 A1 3/2008 Cok
2008/0055210 A1 3/2008 Cok
(Continued)

FOREIGN PATENT DOCUMENTS

CN 101290744 A 10/2008
CN 101300618 A 11/2008
(Continued)

*Primary Examiner* — Aneeta Yodichkas
(74) *Attorney, Agent, or Firm* — Nathan & Associates; Menachem Nathan

(57) ABSTRACT

A display device and a method of compensating the same are provided. The display device includes a display panel, an optical sensor, and a control unit. The optical sensor is disposed behind the display panel and configured to provide first optically sensed data and second optically sensed data. The control unit is electrically connected the optical sensor and the display panel and configured to determine service life of the display panel based on the first optically sensed data and the second optically sensed data and provide a compensation to the display panel.

16 Claims, 4 Drawing Sheets

(52) U.S. Cl.
CPC . *G09G 2320/045* (2013.01); *G09G 2360/142* (2013.01); *G09G 2360/148* (2013.01)

(56) References Cited

U.S. PATENT DOCUMENTS

| | | | | |
|---|---|---|---|---|
| 2014/0085172 | A1 | 3/2014 | Wu et al. | |
| 2014/0306979 | A1 | 10/2014 | Chun et al. | |
| 2015/0257239 | A1* | 9/2015 | Robinson ..... | H05B 45/60 315/151 |
| 2015/0379922 | A1 | 12/2015 | Zhang | |
| 2016/0078813 | A1 | 3/2016 | Mizukoshi | |
| 2018/0033374 | A1 | 2/2018 | Jeong et al. | |
| 2018/0240385 | A1 | 8/2018 | Jaffari et al. | |
| 2018/0308422 | A1 | 10/2018 | Hwang et al. | |
| 2019/0006595 | A1 | 1/2019 | Xu et al. | |

FOREIGN PATENT DOCUMENTS

| | | | |
|---|---|---|---|
| CN | 101369405 | A | 2/2009 |
| CN | 101697273 | A | 4/2010 |
| CN | 103700331 | A | 4/2014 |
| CN | 104021761 | A | 9/2014 |
| CN | 104103236 | A | 10/2014 |
| CN | 105280139 | A | 1/2016 |
| CN | 105741771 | A | 7/2016 |
| CN | 105810135 | A | 7/2016 |
| CN | 105895007 | A | 8/2016 |
| CN | 106250641 | A | 12/2016 |
| CN | 107665673 | A | 2/2018 |
| CN | 106782303 | B | 12/2018 |
| CN | 106847180 | B | 1/2019 |
| KR | 101934327 | B1 | 1/2019 |

* cited by examiner

DISPLAY DEVICE AND METHOD OF COMPENSATING SAME

FIELD OF INVENTION

The present disclosure relates to touch panel technologies, and more particularly, to a display device and a method of compensating the same.

BACKGROUND OF INVENTION

Electronic products inevitably age during use, particularly organic light emitting diode (OLED) panels. Efficiency of OLED displays gradually reduce over time. Brightness will decrease and chromaticity will shift, which will have a great impact on user experience. Not only quality of a panel decreases to affect quality in use, but also service life of the panel and how long it can be used are not known.

Therefore, there is a need for a display device and a method of compensating the same to solve the above problems.

SUMMARY OF INVENTION

In view of the above, the present disclosure provides display device and a method of compensating the same to resolve above-mentioned technical problem.

In order to achieve above-mentioned object of the present disclosure, one embodiment of the disclosure provides a display device including a display panel, an optical sensor, and a control unit. The optical sensor is disposed behind the display panel and configured to provide first optically sensed data and second optically sensed data. The control unit is electrically connected the optical sensor and the display panel and configured to determine service life of the display panel based on the first optically sensed data and the second optically sensed data and provide a compensation to the display panel.

In one embodiment of the disclosure, the control unit is configured to control the optical sensor to obtain the first optically sensed data and the second optically sensed data and record when the optical sensor obtained the data.

In one embodiment of the disclosure, the compensation is an electrical current compensation or a voltage compensation.

In one embodiment of the disclosure, the display panel includes at least a monochromatic sub-pixel. The control unit is configured to supply electrical power to the monochromatic sub-pixel of the display panel after multiplying an original electrical power supply value of the monochromatic sub-pixel by a compensation value.

In one embodiment of the disclosure, the display panel includes three monochromatic sub-pixels of different colors. The control unit is configured to supply electrical power to the three monochromatic sub-pixels of different colors of the display panel after multiplying an original electrical power supply matrix of the three monochromatic sub-pixel of different colors by a compensation matrix.

In one embodiment of the disclosure, the control unit is configured to control the optical sensor to obtain third optically sensed data after the compensation and continue with the compensation if a difference between the third optically sensed data and the first optically sensed data is greater than 10%.

In one embodiment of the disclosure, the first optically sensed data and the second optically sensed data includes a light intensity or chromaticity of a monochromatic sub-pixel.

In one embodiment of the disclosure, the first optically sensed data and the second optically sensed data include a light intensity or chromaticity of each of three monochromatic sub-pixels of different colors.

Furthermore, another embodiment of the disclosure provides a display device including a display panel, an optical sensor, and a control unit. The optical sensor is disposed behind the display panel and configured to provide first optically sensed data and second optically sensed data. The control unit is electrically connected the optical sensor and the display panel and configured to determine service life of the display panel based on the first optically sensed data and the second optically sensed data and provide a compensation to the display panel. The display panel includes three monochromatic sub-pixels of different colors. The control unit is configured to supply electrical power to the three monochromatic sub-pixels of different colors of the display panel after multiplying an original electrical power supply matrix of the three monochromatic sub-pixels of different colors by a compensation matrix.

In one embodiment of the disclosure, the control unit is configured to control the optical sensor to obtain third optically sensed data after the compensation and continue with the compensation if a difference between the third optically sensed data and the first optically sensed data is greater than 10%.

In one embodiment of the disclosure, the first optically sensed data and the second optically sensed data include a light intensity or chromaticity of each of three monochromatic sub-pixels of different colors.

Furthermore, another embodiment of the disclosure provides a method of compensating a display device including steps of:

S1: supplying a first electrical power supply value to a display panel at a first time and detecting a light emitting condition to obtain first optically sensed data;

S2: supplying a first electrical power supply value to a display panel at a second time and detecting a light emitting condition to obtain second optically sensed data;

S3: comparing the first optically sensed data with the second optically sensed data and the first time with the second time to determine an aging degree of the display device;

S4: multiplying the first electrical power value by a compensation value to obtain a second electrical power supply value, supplying the second electrical power supply value to the display panel, and detecting a light emitting condition to obtain third optically sensed data;

S5: determining whether a difference between the first optically sensed data and the third optically sensed data is less than 10%; and

S6: adjusting the compensation value and returning to step S4 if the difference between the first optically sensed data and the third optically sensed data is greater than 10%.

In one embodiment of the disclosure, the first optically sensed data, the second optically sensed data, the third optically sensed data, and the first electrical power supply value all include data corresponding to three monochromatic sub-pixels of different colors.

In one embodiment of the disclosure, the method of compensating a display device further includes a step of providing a control unit and an optical sensor. The control unit is configured to control the optical sensor to obtain the first optically sensed data and the second optically sensed data and record when the optical sensor obtained the data.

In one embodiment of the disclosure, the second electrical power supply value is electrical current value or voltage value.

In one embodiment of the disclosure, the display panel includes at least a monochromatic sub-pixel. The method of compensating the display device includes supplying electrical power to the monochromatic sub-pixel of the display panel after multiplying the first electrical power supply value of the monochromatic sub-pixel by a compensation value.

In one embodiment of the disclosure, the display panel includes three monochromatic sub-pixels of different colors. The method of compensating the display device includes supplying electrical power to the three monochromatic sub-pixels of different colors of the display panel after multiplying a first electrical power supply matrix of the three monochromatic sub-pixel of different colors by a compensation matrix.

In one embodiment of the disclosure, the control unit is configured to control the optical sensor to obtain third optically sensed data in step S4.

In one embodiment of the disclosure, the first optically sensed data and the second optically sensed data include a light intensity or chromaticity of a monochromatic sub-pixel In comparison with prior art, the display device and the method of compensating the same of the disclosure provide the optical sensor disposed behind the display panel and configured to provide first optically sensed data and second optically sensed data. The control unit is electrically connected the optical sensor and the display panel and configured to determine service life of the display panel based on the first optically sensed data and the second optically sensed data and provide a compensation to the display panel. Therefore, the embodiments of the present disclosure can estimate service life of a panel and compensate for insufficient brightness or chromaticity shift caused by material aging.

DETAILED DESCRIPTION OF PREFERRED EMBODIMENTS

The following description of the embodiments is provided by reference to the following drawings and illustrates the specific embodiments of the present disclosure. Directional terms mentioned in the present disclosure, such as "up," "down," "top," "bottom," "forward," "backward," "left," "right," "inside," "outside," "side," "peripheral," "central," "horizontal," "peripheral," "vertical," "longitudinal," "axial," "radial," "uppermost" or "lowermost," etc., are merely indicated the direction of the drawings. Therefore, the directional terms are used for illustrating and understanding of the application rather than limiting thereof.

Figure 1:
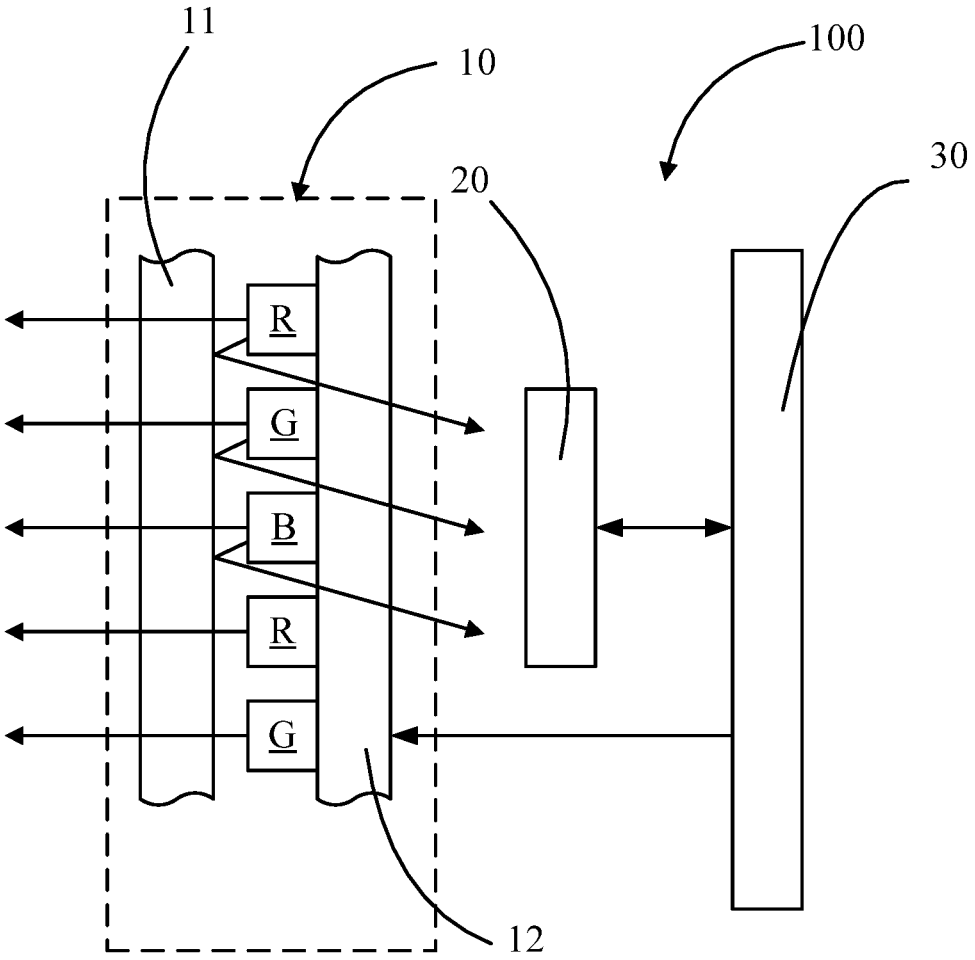
FIG. 1 is a schematic view of a structure of a display device according to an embodiment of the present disclosure.
Figure 4:
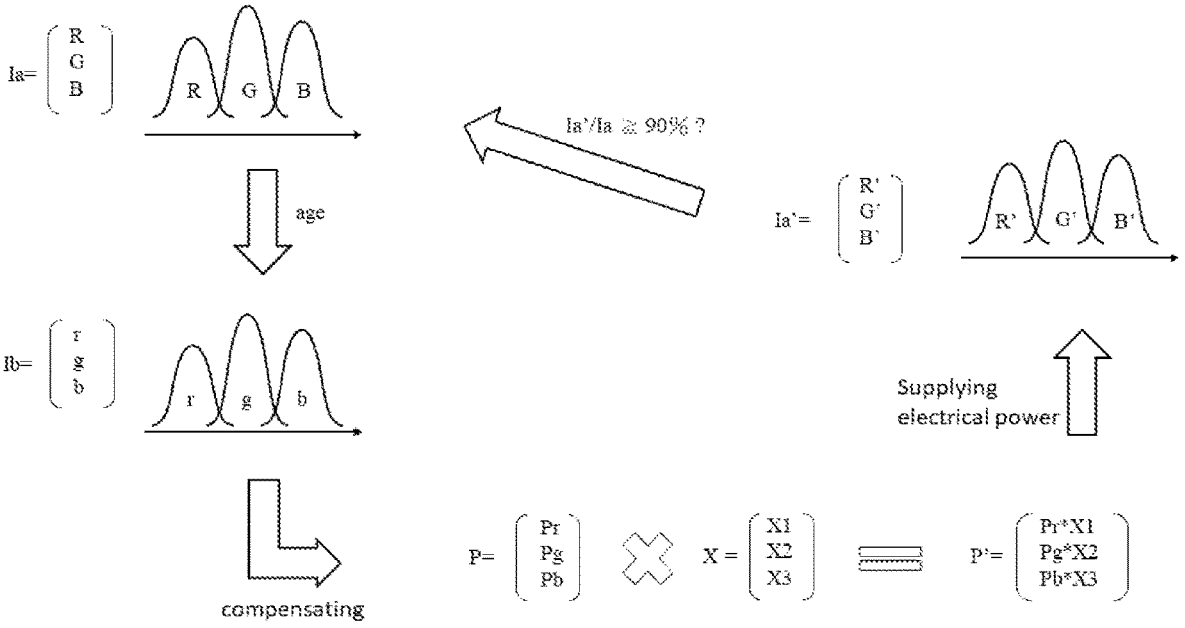
FIG. 4 is a schematic view of a compensating flow of a display device according to an embodiment of the present disclosure.

Referring to FIGS. 1 and 4, one embodiment of the disclosure provides a display device 100 including a display panel 10, an optical sensor 20, and a control unit 30. The optical sensor 20 is disposed behind the display panel 10 and configured to provide first optically sensed data Ia and second optically sensed data Ib. The control unit 30 is electrically connected the optical sensor 20 and the display panel 10 and configured to determine service life of the display panel 10 based on the first optically sensed data Ia and the second optically sensed data Ib and provide a compensation to the display panel 10.

In detail, the display panel 10 can include components such as a substrate 12 and a cover glass 11. Light emitted from the display panel 10 is partially reflected or leaked, and thus reaches the optical sensor 20 located behind the display panel 10. The optical sensor 20 behind the display panel 10 can therefore sense a portion of the light emitted from the display panel 10 located therebefore. The present invention does not limit a manner in which the light reaches the optical sensor 20.

In one embodiment of the disclosure, the control unit 30 is configured to control the optical sensor 20 to obtain the first optically sensed data Ia and the second optically sensed data Ib and record when the optical sensor 20 obtained the data.

In one embodiment of the disclosure, the compensation is an electrical current compensation or a voltage compensation.

In one embodiment of the disclosure, the display panel 10 includes at least a monochromatic sub-pixel. A method of providing the compensation to the display panel 10 by the control unit 30 includes supplying electrical power to the monochromatic sub-pixel of the display panel 10 after multiplying an original electrical power supply value P of the monochromatic sub-pixel by a compensation value X.

In detail, FIG. 1 illustrates an example of a three-color monochrome sub-pixel, but the present invention is not limited thereto. There needs at least one monochrome sub-pixel, such as red, or green. It can also provide two or three colors of the monochrome sub-pixel. It is also possible to have more numbers of the monochrome sub-pixels of one color than other colors, such as a combination of red, green, green, and blue (RGGB).

In one embodiment of the disclosure, the display panel includes three monochromatic sub-pixels R, G, and B of different colors. A method of providing the compensation to the display panel 10 by the control unit 30 includes supplying electrical power to the three monochromatic sub-pixels R, G, and B of the display panel 10 after multiplying an original electrical power supply matrix P of the three monochromatic sub-pixel R, G, and B by a compensation matrix X.

In detail, the compensation value may be provided in advance, or a table of compensation value may be provided in a storage component of the control unit 30 or in another storage component. The compensation value can compensate the three-color monochrome sub-pixels R, G, and B with different degrees of compensation values X1, X2, and X3 in consideration of the white balance of the screen.

In one embodiment of the disclosure, the control unit 30 is configured to control the optical sensor 20 to obtain third optically sensed data Ia' after the compensation and continue with the compensation if a difference between the third optically sensed data Ia' and the first optically sensed data Ia is greater than 10%.

In one embodiment of the disclosure, the first optically sensed data Ia and the second optically sensed data Ib includes a light intensity or chromaticity of a monochromatic sub-pixel.

In one embodiment of the disclosure, the first optically sensed data Ia and the second optically sensed data Ib include a light intensity or chromaticity of each of the three monochromatic sub-pixels R, G, and B.

Figure 3A:
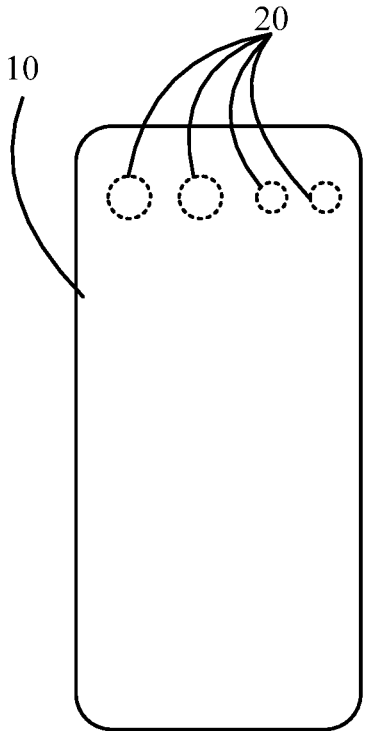
FIG. 3A is a schematic view of a sensing range of a display device according to an embodiment of the present disclosure.
Figure 3B:
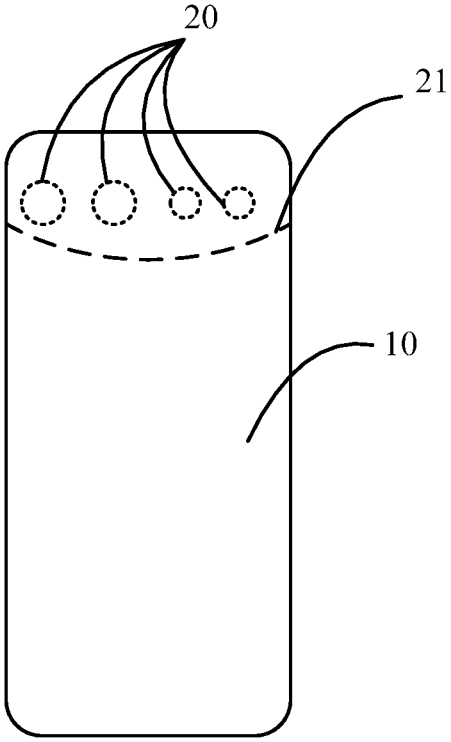
FIG. 3B is a schematic view of another sensing range of a display device according to an embodiment of the present disclosure.
Figure 3C:
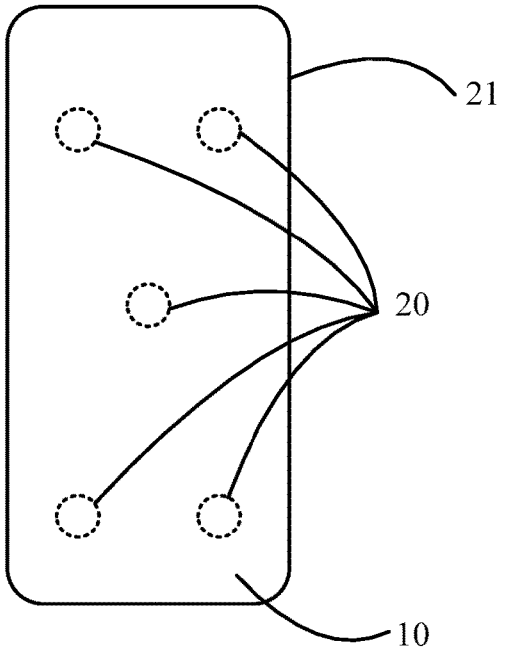
FIG. 3C is a schematic view of still another sensing range of a display device according to an embodiment of the present disclosure.

Referring to FIGS. 3A and 3B, a sensing range 21 of the optical sensor 20 may be equal to a size of a receiving surface of the optical sensor 20 (FIG. 3A) or a slightly larger size (FIG. 3B), or may be the same as the entire display panel 10 (FIG. 3C). The present invention is not limited thereto. The invention also does not limit a number, location, type and size of the optical sensors 20.

Figure 2:
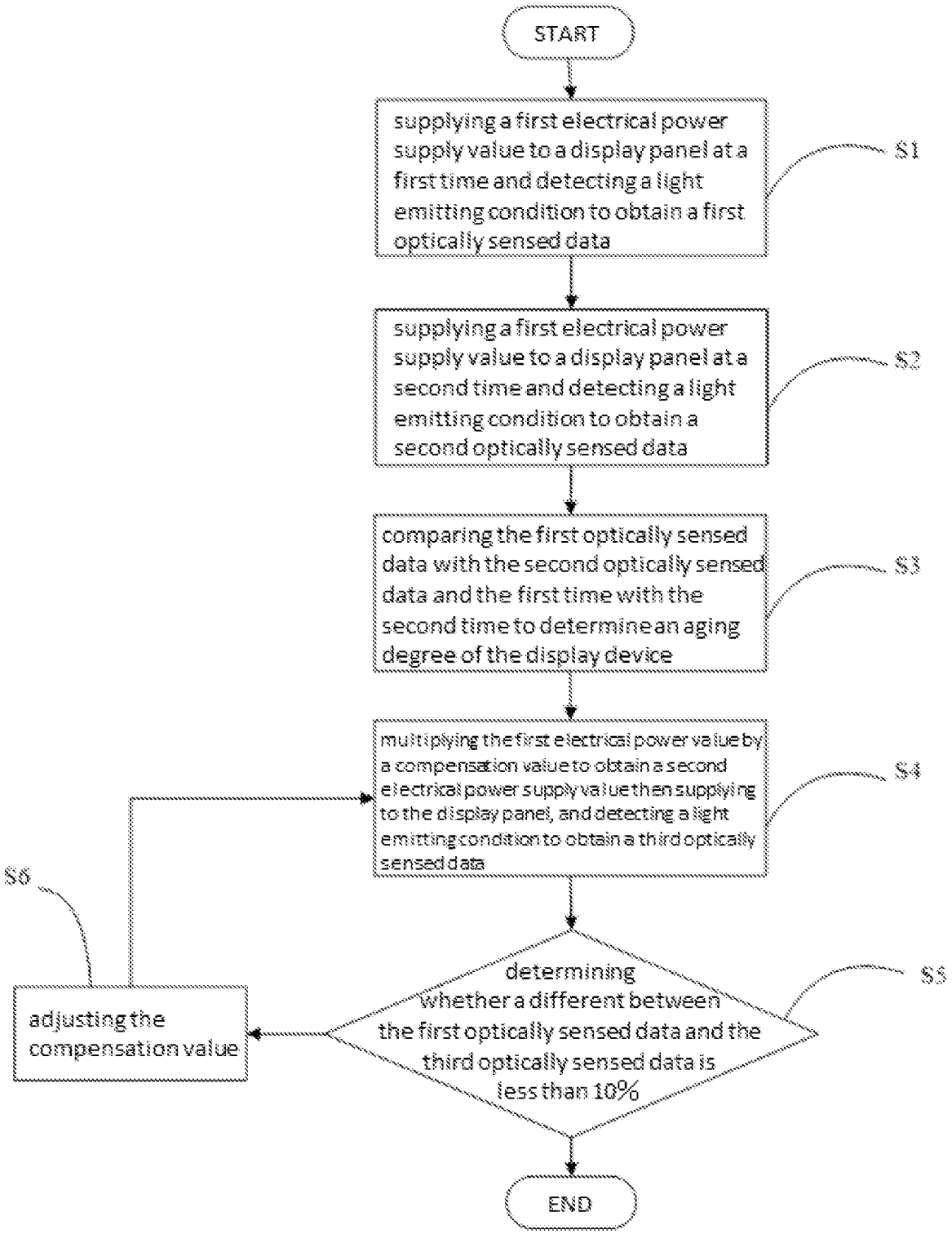
FIG. 2 is a schematic flow chart of a method of compensating a display device according to an embodiment of the present disclosure.

Referring to FIGS. 1, 2, and 4, furthermore, another embodiment of the disclosure provides a method of compensating a display device 10 including steps of:

S1: supplying a first electrical power supply value P to a display panel 10 at a first time and detecting a light emitting condition to obtain first optically sensed data Ia;

S2: supplying a first electrical power supply value P to a display panel 10 at a second time and detecting a light emitting condition to obtain second optically sensed data Ib;

S3: comparing the first optically sensed data Ia with the second optically sensed data Ib and the first time with the second time to determine an aging degree of the display device 10;

S4: multiplying the first electrical power value P by a compensation value X to obtain a second electrical power supply value P', supplying the second electrical power supply value P' to the display panel 10, and detecting a light emitting condition to obtain third optically sensed data Ia';

S5: determining whether a difference between the first optically sensed data Ia and the third optically sensed data Ia' is less than 10%; and S6: adjusting the compensation value X and returning to step S4 if the difference between the first optically sensed data Ia and the third optically sensed data Ia' is greater than 10%.

In one embodiment of the disclosure of the method of compensating a display device 10, the first optically sensed data Ia, the second optically sensed data Ib, the third optically sensed data Ia', and the first electrical power supply value P all include data corresponding to three monochromatic sub-pixels R, G, and B.

In detail, FIG. 1 illustrates an example of the three-color monochrome sub-pixel, but the present invention is not limited thereto. There needs at least one monochrome sub-pixel, such as red, or green. It can also provide two or three colors of the monochrome sub-pixel. It is also possible to have more numbers of the monochrome sub-pixels of one color than other colors, such as a combination of red, green, green, and blue (RGGB).

In comparison with prior art, the display device and the method of compensating the same of the disclosure provide the optical sensor disposed behind the display panel and configured to provide first optically sensed data and second optically sensed data. The control unit is electrically connected the optical sensor and the display panel and configured to determine service life of the display panel based on the first optically sensed data and the second optically sensed data and provide a compensation to the display panel. Therefore, the embodiments of the present disclosure can estimate service life of a panel and compensate for insufficient brightness or chromaticity shift caused by material aging.

The present disclosure has been described by the above embodiments, but the embodiments are merely examples for implementing the present disclosure. It must be noted that the embodiments do not limit the scope of the invention. In contrast, modifications and equivalent arrangements are intended to be included within the scope of the invention.

What is claimed is:

1. A display device, comprising:

a display panel comprising a plurality of monochromatic sub-pixels;

an optical sensor; and a control unit, wherein the optical sensor is disposed behind the display panel and configured to provide first optically sensed data and second optically sensed data;

the control unit is electrically connected the optical sensor and the display panel and configured to determine service life of the display panel based on the first optically sensed data and the second optically sensed data and provide a compensation to the display panel;

the control unit is configured to supply electrical power to the monochromatic sub-pixels of the display panel after multiplying an original electrical power supply value of the monochromatic sub-pixels by a compensation value;

the control unit is configured to control the optical sensor to obtain the first optically sensed data and the second optically sensed data and record when the optical sensor obtains the data; and the compensation is an electrical current compensation or a voltage compensation.

2. The display device according to claim 1, wherein the display panel comprises three monochromatic sub-pixels of different colors, and the control unit is configured to supply electrical power to the three monochromatic sub-pixels of different colors of the display panel after multiplying an original electrical power supply matrix of the three monochromatic sub-pixels of different colors by a compensation matrix.

3. The display device according to claim 1, wherein the control unit is configured to control the optical sensor to obtain third optically sensed data after the compensation and continue with the compensation if a difference between the third optically sensed data and the first optically sensed data is greater than 10%.

4. The display device according to claim 1, wherein the first optically sensed data and the second optically sensed data comprise a light intensity or chromaticity of a monochromatic sub-pixel.

5. The display device according to claim 1, wherein the first optically sensed data and the second optically sensed data comprise a light intensity or chromaticity of each of three monochromatic sub-pixels of different colors.

6. A display device, comprising:

a display panel;

an optical sensor; and a control unit, wherein:

the optical sensor is disposed behind the display panel and configured to provide first optically sensed data and second optically sensed data;

the control unit is electrically connected the optical sensor and the display panel and configured to determine service life of the display panel based on the first optically sensed data and the second optically sensed data and provide a compensation to the display panel; and the display panel comprises three monochromatic sub-pixels of different colors, and the control unit is configured to supply electrical power to the three monochromatic sub-pixels of different colors of the display panel after multiplying an original electrical power supply matrix of the three monochromatic sub-pixels of different colors by a compensation matrix.

7. The display device according to claim 6, wherein the control unit is configured to control the optical sensor to obtain third optically sensed data after the compensation and continue with the compensation if a difference between the third optically sensed data and the first optically sensed date is greater than 10%.

8. The display device according to claim 6, wherein the first optically sensed data and the second optically sensed data comprise a light intensity or chromaticity of each of three monochromatic sub-pixels of different colors.

9. A method of compensating a display device, comprising steps of:

S1: supplying a first electrical power supply value to a display panel at a first time and detecting a light emitting condition to obtain first optically sensed data;

S2: supplying a first electrical power supply value to a display panel at a second time and detecting a light emitting condition to obtain second optically sensed data;

S3: comparing the first optically sensed data with the second optically sensed data and the first time with the second time to determine an aging degree of the display device;

S4: multiplying the first electrical power value by a compensation value to obtain a second electrical power supply value, supplying the second electrical power supply value to the display panel, and detecting a light emitting condition to obtain third optically sensed data;

S5: determining whether a difference between the first optically sensed data and the third optically sensed data is less than 10%; and S6: adjusting the compensation value and returning to step S4 if the difference between the first optically sensed data and the third optically sensed data is greater than 10%.

10. The method of compensating the display device according to claim 9, wherein the first optically sensed data, the second optically sensed data, the third optically sensed data, and the first electrical power supply value all comprise data corresponding to three monochromatic sub-pixels of different colors.

11. The method of compensating the display device according to claim 9, further comprising a step of: providing a control unit and an optical sensor, wherein the control unit is configured to control the optical sensor to obtain the first optically sensed data and the second optically sensed data and record when the optical sensor obtains the data.

12. The method of compensating the display device according to claim 11, wherein the second electrical power supply value is an electrical current value or a voltage value.

13. The method of compensating the display device according to claim 11, wherein the display panel comprises at least a monochromatic sub-pixel, and the method of compensating the display device comprises supplying electrical power to the monochromatic sub-pixel of the display panel after multiplying the first electrical power supply value of the monochromatic sub-pixel by a compensation value.

14. The method of compensating the display device according to claim 11, wherein the display panel comprises three monochromatic sub-pixels of different colors, and the method of compensating the display device comprises supplying electrical power to the three monochromatic sub-pixels of different colors of the display panel after multiplying a first electrical power supply matrix of the three monochromatic sub-pixels of different colors by a compensation matrix.

15. The method of compensating the display device according to claim 11, wherein the control unit is configured to control the optical sensor to obtain the third optically sensed data in step S4.

16. The method of compensating the display device according to claim 9, wherein the first optically sensed data and the second optically sensed data comprise a light intensity or chromaticity of a monochromatic sub-pixel.

* * * * *